United States Patent [19]

Larson

[11] Patent Number: 5,074,001

[45] Date of Patent: Dec. 24, 1991

[54] WATERBED MATTRESS INSULATION WITH HEAT TRANSFER HOLES AT A GREATER DENSITY TOWARDS FOOT END OF MATTRESS

[76] Inventor: Lynn D. Larson, 1052 N. Lakeshore Dr., Lincoln, Nebr. 68526

[21] Appl. No.: 539,173

[22] Filed: Jun. 18, 1990

[51] Int. Cl.[5] ..... A47C 27/08

[52] U.S. Cl. ..... 5/422; 5/450; 5/451

[58] Field of Search ..... 5/422, 450, 451

[56] References Cited

U.S. PATENT DOCUMENTS

| | | | |
|---|---|---|---|
| 4,301,560 | 11/1981 | Fraige | 5/451 |
| 4,411,033 | 10/1983 | Morgan | 5/451 |
| 4,475,257 | 10/1984 | Phillips | 5/450 |
| 4,523,343 | 6/1985 | Fraige | 5/450 |
| 4,575,885 | 3/1986 | Hall | 5/450 |
| 4,577,356 | 3/1986 | Johenning et al. | 5/450 |
| 4,652,726 | 3/1987 | Femino et al. | 5/451 |
| 4,663,789 | 5/1987 | Smith | 5/450 |
| 4,864,670 | 9/1989 | Woll et al. | 5/451 |
| 4,961,237 | 10/1990 | Santo | 5/451 |
| 4,975,995 | 12/1990 | Luchonok | 5/450 |

FOREIGN PATENT DOCUMENTS

| | | | |
|---|---|---|---|
| 1288319 | 9/1972 | United Kingdom | 5/422 |
| 8001036 | 5/1980 | World Int. Prop. O. | 5/451 |

*Primary Examiner*—Eric K. Nicholson

*Attorney, Agent, or Firm*—John A. Beehner

[57] ABSTRACT

An improved waterbed mattress includes a bladder having a layer of insulation material extending substantially from end to end and side to side therein, which insulation material has a plurality of generally upright holes opening through the top and bottom surfaces thereof for improved heat transfer from the warmed body of water below the insulation material to the top surface of the bladder 12. The holes are preferably arranged in a pattern having a greater density of holes toward the foot end of the mattress and a decreased density of holes toward the head end of the mattress.

6 Claims, 2 Drawing Sheets

WATERBED MATTRESS INSULATION WITH HEAT TRANSFER HOLES AT A GREATER DENSITY TOWARDS FOOT END OF MATTRESS

BACKGROUND OF THE INVENTION

The present invention is directed generally to an improved waterbed mattress bladder having a layer of insulation material therein and more particularly to such a waterbed mattress having a plurality of upright holes through the layer of insulation material for improved heat transfer from the heated water below the insulation material to the top surface of the bladder for warming a user reclining thereon.

It is common for waterbed mattress bladders to include a layer of insulation material such as fiber or foam to effect wave dampening within the waterbed mattress bladder in response to movements of a user reclining on the top surface of the bladder. It is also common to use heater elements in connection with waterbed mattress bladders for maintaining a comfortable temperature of the water within the bladder. A problem with conventional waterbed mattresses is that the layer of insulation material not only provides mechanical insulation to dampen waves but also provides thermal insulation between the top surface of the bladder and the warmed water below the layer of insulation material. A certain degree thermal inefficiency is, therefore, built into such mattresses.

Another problem with waterbed mattresses is that the heat from the waterbed heater is distributed generally uniformly across the top surface of the waterbed mattress bladder. Further inefficiencies are effected in this manner since it has been found that comfort is generally maximized by providing a greater degree of heat toward the foot end of the mattress and a lesser degree of heat toward the head end of the mattress.

Accordingly, a primary object of the invention is to provide improved thermal efficiency for a waterbed mattress of the type including a layer of insulation material within the bladder for wave reduction.

Another object is to provide such a waterbed mattress with a plurality of upright holes through the layer of insulation material for improved heat transfer to the top surface of the bladder through the water in the holes.

Another object is to provide such a waterbed mattress wherein the holes through the body of insulation material are arranged in a pattern having greater density of holes toward the foot end of the mattress and a decreased density of holes toward the head end of the mattress.

Another object is to provide an improved waterbed mattress which is simple and rugged in construction, economical to manufacture and efficient in operation.

SUMMARY OF THE INVENTION

The present invention is directed to an improvement to the known combination of a waterbed mattress and heater. The mattress includes a bladder having top and bottom surfaces, opposite sides and opposite head and foot ends. A layer of insulation material is disposed within the bladder and extends substantially from end to end and side to side for positional stability therein. The heater is operative for warming water within the bladder below the layer of insulation material. The improvement of the present invention includes a plurality of generally upright holes through the layer of insulation material with the holes having opposite ends opening through the top and bottom surfaces of the layer of insulation material so that, upon filling said bladder with water and placement of the heater in heat transfer relation with the water therein, heat transfer is effected from the water warmed by the heater below said layer of insulation material through the water in said holes to the top surface of the bladder for warming a user reclining thereon.

For maximum comfort, the holes are preferably arranged in a pattern having a greater density of holes toward the foot end of the waterbed mattress and a decreased density of holes toward the head end of the mattress. The body of insulation material may be foam, fiber, or any other insulating wave reduction material. The thickness of the layer of insulation material is preferably less than the height of the bladder sides and ends so that a body of warmed water is disposed below and throughout the layer of insulation material.

DESCRIPTION OF THE PREFERRED EMBODIMENT

Figure 1:
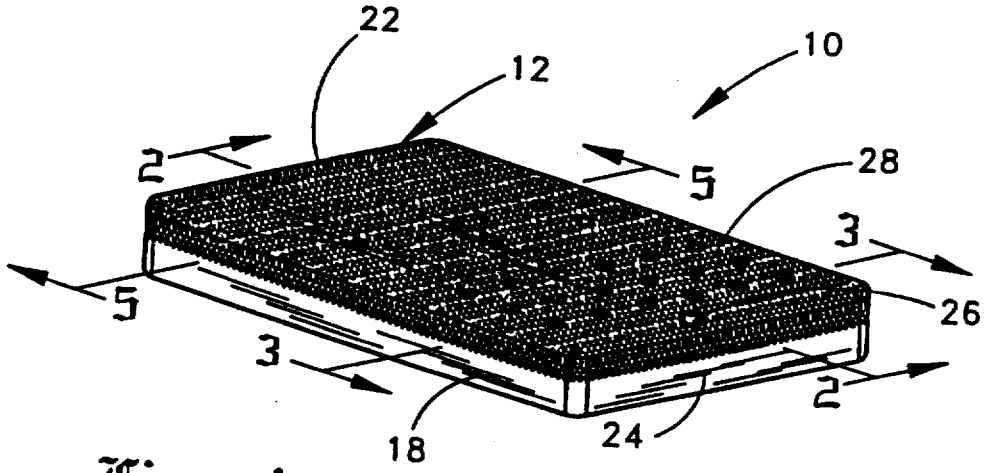
FIG. 1 is a perspective view of a waterbed mattress with the bladder illustrated in outline form only for exposing the layer of insulation material therein.

The waterbed mattress 10 of the present invention includes a bladder 12 having top and bottom surfaces 14 and 16, opposite sides 18 and 20 and opposite head and foot ends 22 and 24. Bladder 12 is generally formed of a plastic or vinyl sheet material having thermal welded seams so that the bladder defines a water-tight containment chamber having a water filler opening and plug 26 for filling the bladder with water and emptying water therefrom.

A layer of insulation material 28 is placed within the bladder during formation of the bladder to provide wave reduction for the mattress. That insulation material may be an open cell foam, fiber or any other insulating wave reducing material. Examples of suitable foam include polyethylene and polyurethane. The insulation material 28 preferably extends substantially from end to end and side to side within the bladder for positional stability and for improved wave dampening efficiency. The thickness of the layer of insulation material 28 is preferably less than the height of the sides 18 and 20 and ends 22 and 24 so that a body of water 30 is formed below the insulation material 28. At least a thin layer of water 32 is disposed above the insulation material 28, but that layer is of minimal thickness due to the buoyancy of the insulation material.

Figure 2:
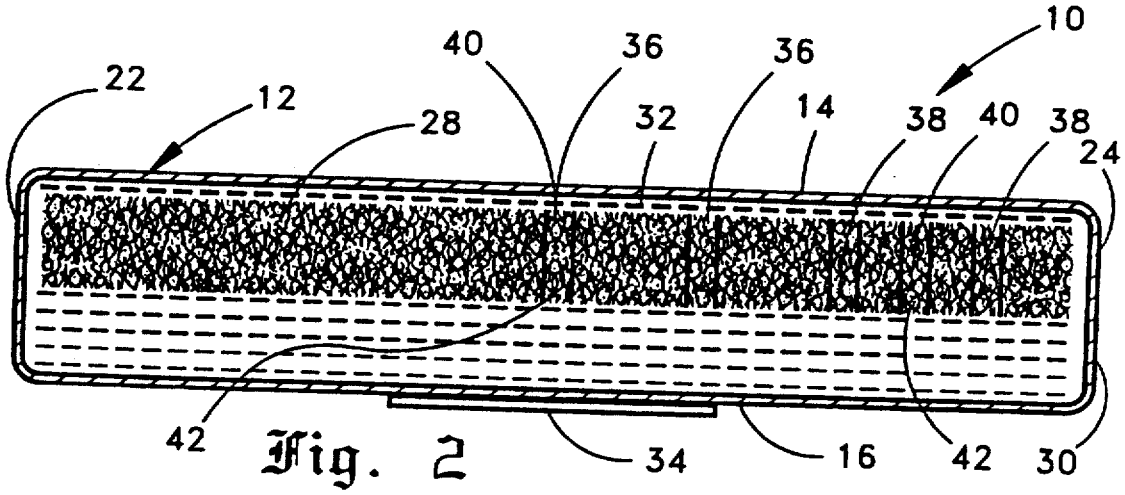
FIG. 2 is a longitudinal sectional view taken along line 2—2 in FIG. 1.
Figure 3:
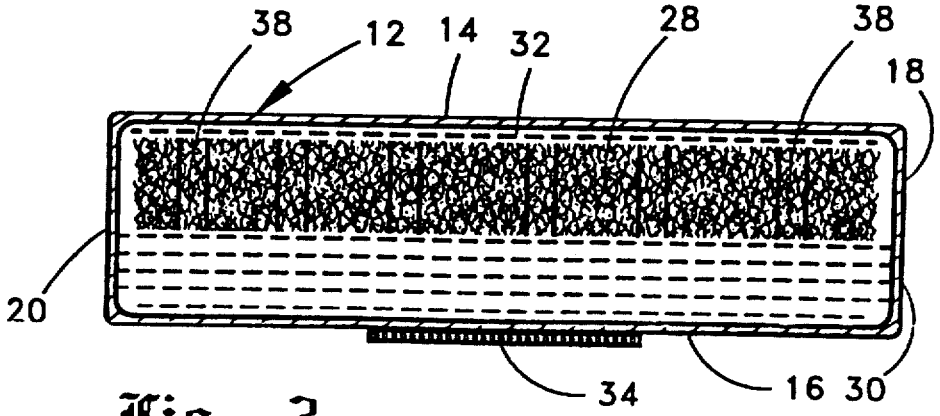
FIG. 3 is a transverse sectional view taken along line 3—3 in FIG. 1.
Figure 4:
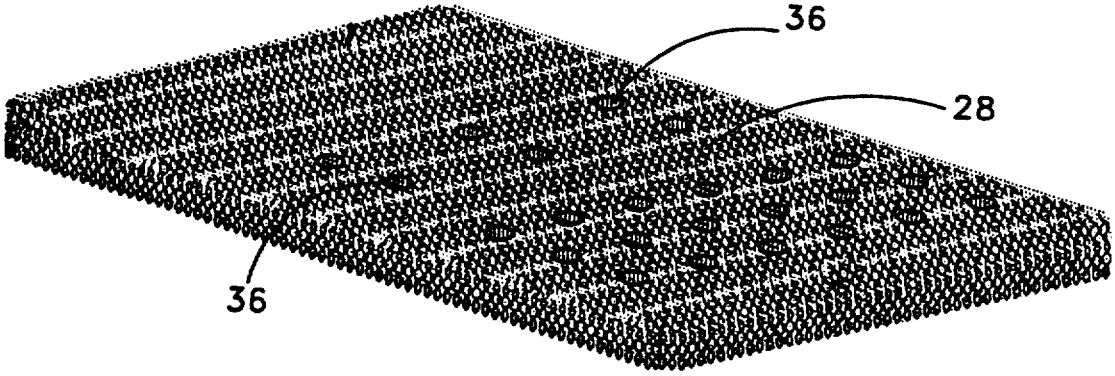
FIG. 4 is a perspective view of the layer of insulation material for the waterbed mattress of the invention.

As illustrated in FIGS. 2 and 3, a waterbed heater pad 34 is placed below the waterbed mattress 10 in heat transfer relation with the body of water 30 for warming the water to a comfortable temperature for users reclining on the waterbed.

The improvement of the present invention is directed to the plurality of generally upright holes 36 and 38 through the layer of insulation material 28. Each hole has opposite top and bottom ends 40 and 42 which open through the top and bottom surfaces 14 and 16 of the layer of insulation material 28 so that, upon filling of the bladder 12 with water and placement of the heater 34 in heat transfer relation with the water therein, heat transfer is effected from the warmed body of water 30 through the water in the holes to the top surface 14 of the bladder for warming a user reclining thereon.

The size of the holes 36 and 38 is not critical to the present invention. The diameter of the holes is preferably between one and four inches (1–4"). The thickness of the layer of insulation material 28 is generally either two inches (2"), four inches (4") or six inches (6").

For improved comfort and thermal efficiency, the holes 36 and 38 are preferably arranged in a pattern having a greater density of holes toward the foot end 24 of bladder 12 and a decreased density toward the head end 22. Whereas the pattern of holes through the layer of insulation material 28 is likewise not critical to the invention, a preferred pattern is illustrated in the drawings wherein three rows of seven (7) holes 38 are provided adjacent the foot end 24 of the layer of insulation material 28. The holes are two inches (2") in diameter and arranged six inches (6") on center with the end most row spaced approximately six inches (6") from the foot end 24 of the bladder 12. Another six (6) holes 36 are arranged in two (2) rows of three (3) holes each across the center of the layer of insulation material 28. These holes are likewise two inches (2") in diameter and arranged twelve inches (12") on center with one row spaced twelve inches (12") from the adjacent row of holes 38. No holes are provided through the section of insulation material closest to the head end 22 of the mattress.

Figure 5:
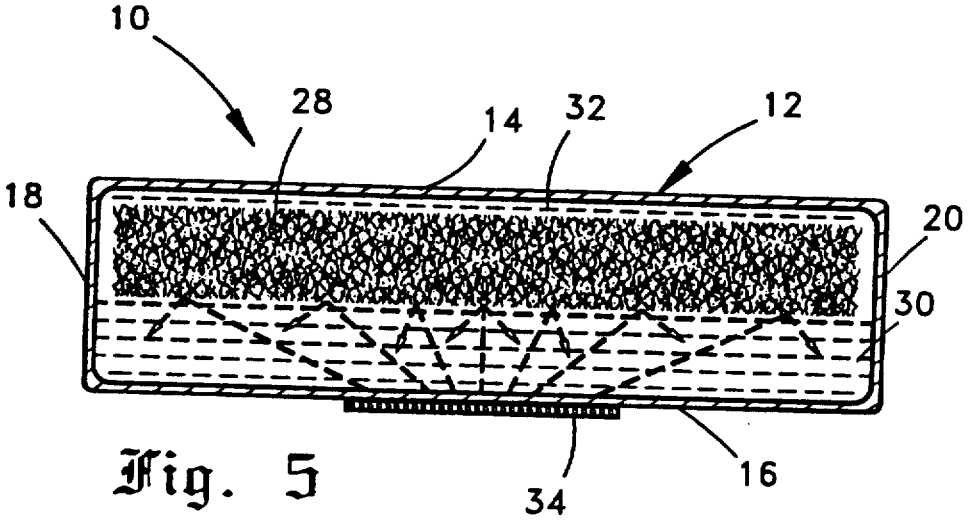
FIG. 5 is a transverse sectional view taken along line 5—5 in FIG. 1.

In operation, whereas the layer of insulation material 28 is intended to provide mechanical insulation from wave movement of water within the bladder 12, it also affords a certain degree of thermal insulation between the warm body of water 30 and top surface 14 of the bladder 12. This property is illustrated in the sectional view of FIG. 5 taken adjacent the head end of the mattress. The dotted line arrows in FIG. 5 illustrate the general distribution of heat transfer from heater pad 34 to the body of water 30. Heat transfer is generally deflected by the layer of insulation material 28 with the result that all or portions of the bladder top surface 14 are somewhat thermally insulated from the warmed body of water 30.

Figure 6:
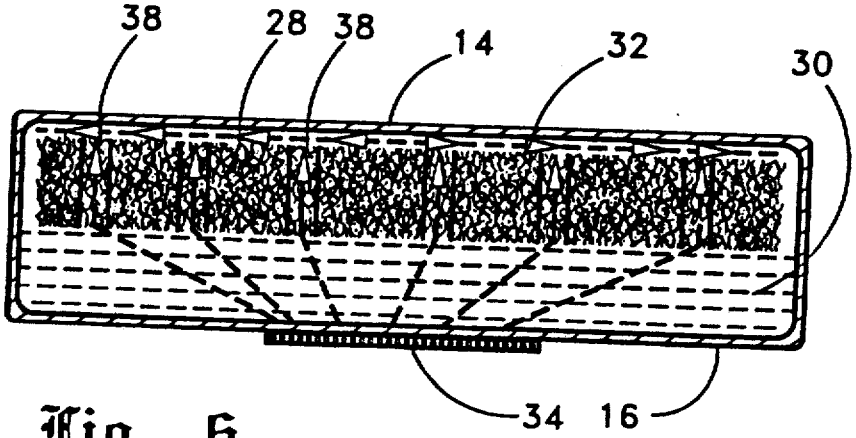
FIG. 6 is a transverse sectional view, similar to FIG. 3, with arrows illustrating heat transfer therein.

FIG. 6, on the other hand, illustrates that the holes 36 and 38 enable heat transfer directly between the warmed body of water 30 and layer of water 32 above the insulation material 28 for effective heat transfer to the top surface 14 of the bladder 12. The greater density of holes toward the foot end of the mattress enables more efficient heat transfer to that end of the mattress top surface so that the foot end of the mattress will be warmer than the center section where the density of holes is less and likewise warmer than the section of the top surface adjacent head Whereas the holes 36 and 38 of the present invention are provided for the purpose of increased heat transfer efficiency, they afford the added advantage of facilitating drainage of water from the bladder 12 by facilitating water flow through the insulation material 28 toward filler opening 26.

Whereas the invention has been shown and described in connection with a preferred embodiment thereof, it is understood that many modifications, additions, and alterations may be made which are within the intended broad scope of the appended claims.

Thus there has been shown and described an improved combination waterbed mattress and heater, which accomplishes at least all of the stated objects.

I claim:

1. In combination, a waterbed mattress bladder having top and bottom surfaces, opposite sides and opposite head and foot ends, a layer of insulation material within the bladder and extending substantially from said foot end to said opposite head end of the bladder and from one side to said opposite side of the bladder, said layer of insulation material having top and bottom surfaces, a heater adapted for placement in heat transfer relation with water in said bladder below said layer of insulation material, the improvement comprising a plurality of generally upright holes through said layer of insulation material, said holes having opposite ends opening through said top and bottom surfaces of said layer of insulation material whereby, upon filling of said bladder with water and placement of said heater in heat transfer relation with water therein, heat transfer is effected from the water warmed by said heater below said layer of insulation material through water in said holes to the top surface of said bladder for warming a user reclining thereon, and said holes being arranged in a pattern having a greater density of holes toward the foot end of the waterbed mattress bladder and a decreased density of holes toward the head end thereof.

2. The combination of claim 1 wherein said layer of insulating material comprises foam.

3. The combination of claim 1 wherein said holes are vertically oriented within said layer of insulation material.

4. The combination of claim 1 wherein said heater comprises a waterbed heater pad adapted for placement beneath the bottom surface of said waterbed mattress bladder.

5. The combination of claim 1 wherein the thickness of said layer of insulation material is less than the height of the bladder sides and ends.

6. The combination of claim 1 wherein said layer of insulation material comprises fiber.

* * * * *